US006516576B1

(12) United States Patent
Balmer

(10) Patent No.: US 6,516,576 B1
(45) Date of Patent: Feb. 11, 2003

(54) TRIM PIECE

(75) Inventor: Brad Balmer, Toronto (CA)

(73) Assignee: Ontario Inc., Toronto (CA)

( * ) Notice: Subject to any disclaimer, the term of this patent is extended or adjusted under 35 U.S.C. 154(b) by 0 days.

(21) Appl. No.: 09/998,690

(22) Filed: Dec. 3, 2001

(51) Int. Cl.[7] ..... E04B 2/00; E04C 2/38
(52) U.S. Cl. ..... 52/287.1; 52/288.1; 52/716.1
(58) Field of Search ..... 52/287.1, 288.1, 52/716.1, 716.8, 717.03, 717.04, 717.05, 717.06

(56) References Cited

U.S. PATENT DOCUMENTS 435,845 A * 9/1890 Marston
2,915,794 A * 12/1959 Hillmann
3,074,521 A * 1/1963 Woods
3,707,061 A * 12/1972 Collette
5,199,237 A * 4/1993 Juntunen
5,809,718 A * 9/1998 Wicks
6,145,259 A * 11/2000 Koenig

* cited by examiner

*Primary Examiner*—Carl D. Friedman
*Assistant Examiner*—Kevin McDermott
(74) *Attorney, Agent, or Firm*—Blake, Cassels & Graydon LLP

(57) ABSTRACT

A trim piece is diclosed that allows from easier placement of trim pieces around corners. An elongated member has a block at an end. The block has an abutment face pointed in a direction to extend around a corner and face down the direction for the next trim piece to be placed. The abutment face may alternatively face in the longitudinal direction of the elongate member, or face in a direction for the next trim piece to be placed on the same surface as the first trim piece.

30 Claims, 6 Drawing Sheets

TRIM PIECE

FIELD OF THE INVENTION

This invention relates to decorative trim pieces for building surface such as walls or ceilings, methods of installing the pieces, and methods of manufacturing the pieces.

BACKGROUND OF THE INVENTION

Decorative trim is used in several situations, such as used with covings, crowns, or as a cornice (trim at a junction between a ceiling and a wall), as a baseboard, (trim at a junction between a floor and a wall), picture rails, wall panel mouldings, door and window casings, or trims attached to a ceiling. Trim can be attached to adjacent surfaces in a number of ways (typically mechanically fastened and/or glued), and presents a three-dimensional decorative surface to the viewing eye when installed.

Previous trims present complications at corners. The appearance of the trim at the corners when installed depends upon several factors including length of the trim's pattern repeat, the desired length of coverage, and the accuracy of the mitred cuts at the ends of the pieces of trim at the corner. Ideally, the mitred cuts should meet smoothly and with mirrored edges across the entire surfaces of the two adjacent pieces of trim. For many installers, especially non-professional installers such as people doing their own home renovations, preparing, laying out and installing pieces of trim with adequate mitre cuts is a time-consuming and frustrating exercise, which is not always entirely successful.

SUMMARY OF THE INVENTION

The present invention improves on prior trim pieces by providing a trim piece with unitary blocks that form part of the pattern of the trim itself. Each of these blocks will provide at least two faces at angles to each other, one of which is connected to the rest of the trim piece. While pan of the decorative trim piece, the blocks are distinctive parts of the decorative trim, ideally presenting decorative breaks or highlights of the pattern, In use to cover an inner or outer corner, a trim piece with a block at one end is positioned so that the trim piece is attached to the surface to be covered and the block is positioned so that a face looks down the second surface to be covered by a second trim piece placed to abut the block. In use to turn ninety degrees on the same surface, a decorative trim piece with a block at one end is positioned so that the trim piece is attached to the surface to be covered and the block is positioned so that a face looks down the same surface at a ninety degree angle. A second decorative trim piece is placed to abut the block.

In one aspect of the invention, there is provided a unitary decorative trim piece for installation on a building surface such as wall or ceiling, the trim piece comprising an elongate member having a central axis and a block at a first end of the member wherein the block has an end face substantially orthogonal to the axis for receipt thereagainst of the end of another trim piece when the pieces are aligned with each other for installation on a common surface.

In a feature of this aspect, the block has an obverse face substantially orthogonal to the end face for receipt thereagainst of the end of another trim piece when the pieces are positioned for installation at an inside corner formed at the juncture of adjacent walls, In another feature of this aspect, the block has a reverse face substantially orthogonal to the end face for receipt thereagainst of the end of another trim piece when the pieces are positioned for installation at an outside corner formed at the juncture of adjacent walls. In yet another feature of this aspect, the block has a lower side face substantially orthogonal to the end face for receipt thereagainst of the end of another trim piece when the pieces are positioned to together form a corner on a common surface. In a still further feature of this aspect, the block has an upper side face substantially orthogonal to the end face for receipt thereagainst of the end of another trim piece when the pieces are positioned to together form a corner on a common surface. In still another feature of this aspect, the block has a reverse face substantially orthogonal to the end face for receipt thereagainst of the end of another trim piece when the pieces are positioned for installation at an outside corner formed at the juncture of adjacent walls. In yet another feature of this aspect, the block has an upper side face substantially orthogonal to the end face for receipt thereagainst of the end of another trim piece when the pieces are positioned to together form a corner on a common surface.

In a second aspect of this invention, there is provided a unitary decorative trim piece for installation on a building surface such as a wall or a ceiling, the trim piece comprising: an elongate member having a decorative obverse face, and a central axis; first and second blocks at first and second ends of the member, wherein each of the blocks has an end face substantially orthogonal to the axis for receipt thereagainst of the end of another trim piece when the pieces are aligned with each other for installation on a common wall; the first block has an obverse face substantially orthogonal to the end face for receipt thereagainst of the end of another trim piece when the pieces are positioned for installation at an inside corner formed at the juncture of adjacent walls and has a reverse face substantially orthogonal to the end face for receipt thereagainst of the end of another trim piece when the pieces are positioned for installation at an outside corner formed at the juncture of adjacent walls; and the second block has a lower side face substantially orthogonal to the end face for receipt thereagainst of the end of another trim piece when the pieces are positioned to together form a corner on a common surface and has an upper side face substantially orthogonal to the end face for receipt thereagainst of the end of another trim piece when the pieces are positioned to together form a corner on a common surface.

In a feature of this second aspect, the end face, obverse face, and reverse face of the first block are coincident with first, second and third surfaces, respectively, of a first imaginary rectangular parallelepiped and the end face, the lower side face, and the upper side face of the second block are coincident with first, second and third surfaces, respectively, of a second imaginary rectangular parallelepiped. In another feature of this aspect, the end face, obverse face, and reverse face of the first block are coincident with first, second and third surfaces, respectively, of an imaginary rectangular parallelepiped and the end face, the lower side face, and the upper side face of the second block are coincident with first, second and third surfaces, respectively, of the imaginary rectangular parallelepiped.

In another aspect of this invention, there is provided a unitary decorative trim piece for installation on a building surface such as a wall or a ceiling, the trim piece comprising: an elongate member having a decorative obverse face; and a block at an end of the elongate member, wherein the block has a face for receipt thereagainst of the end of another trim piece when the pieces are aligned with each other for installation to form a corner on a common wall.

In still another aspect of this invention, there is provided a unitary decorative trim piece for installation on a building surface such as a wall or a ceiling, the trim piece comprising an elongate member having a decorative obverse face; and a block at an end of the elongate member, wherein the block has a face for receipt thereagainst of the end of another trim piece when the pieces are positioned with each other for installation at an inside corner.

In yet another aspect of this invention, there is provided a unitary decorative trim piece for installation on a building surface such as a wall or a ceiling the trim piece comprising: an elongate member having a decorative obverse face; and a block at an end of the elongate member, wherein the block has a face for receipt thereagainst of the end of another trim piece when the pieces are positioned with each other for installation on an outer corner.

In an additional feature of these aspects, the ratio of the length of the elongate member in the direction of the longitudinal axis of the elongate member to the length of the block in the direction of the longitudinal axis of the elongate member is at least 12:1. In another additional feature of these aspects, the ratio of the length of the elongate member in the direction of the longitudinal axis of the elongate member to the length of the block in the direction of the longitudinal axis of the elongate member is at least 20:1.

In still another aspect of the invention, there is provided a unitary decorative trim piece for installation on a building surface such as wall or ceiling, the trim piece comprising: an elongate member having a central axis; a first block at a first end of the member; wherein: the first block has an end face substantially orthogonal to the axis for receipt thereagainst of the end of another trim piece when the pieces are aligned with each other for installation on a common surface; the first block has an obverse face substantially orthogonal to the end face for receipt thereagainst of the end of another trim piece when the pieces are positioned for installation at an inside corner formed at the juncture of adjacent walls; and the first block has a reverse face substantially orthogonal to the end face for receipt thereagainst of the end of another trim piece when the pieces are positioned for installation at an outside corner formed at the juncture of adjacent walls.

In another feature of this aspect, the trim piece further comprises: a second block at a second end of the member; wherein: the second block has an end face substantially orthogonal to the axis for receipt thereagainst of the end of another trim piece when the pieces are aligned with each other for installation on a common surface; the second block has an upper face substantially orthogonal to the end face for receipt thereagainst of the end of another trim piece when the pieces are positioned to together form a corner on a common surface, and the second block has a lower face substantially orthogonal to the end face for receipt thereagainst of the end of another trim piece when the pieces are positioned to together form a corner on a common surface.

In another aspect of the invention, there is provided a commercial package comprising (a) a trim piece and (b) instructions for removing at least one of the blocks thereof so as to provide the elongate member with a free end for abutment with the end face, obverse face or reverse face of the first block, or the end face, the lower side face or the upper side face of the second block, of a second said trim piece.

In still another aspect of the invention, there is provided a commercial package comprising (a) a trim piece and (b) instructions for removing at least one of the blocks thereof and removing part of the elongate member with a square cut so as to provide the elongate member with a free end for abutment with the end face, obverse face or reverse face of the first block, or the end face, the lower side face or the upper side face of the second block, of a second said trim piece.

In yet another aspect of the invention, there is provided a commercial package comprising (a) a trim piece and (b) instructions for removing at both of the blocks thereof so as to provide the elongate member with a first free end for abutment with the end face, obverse face or reverse face of the first block, or the end face, the lower side face or the upper side face of the second block, of a second said trim piece and a second free end for abutment with the end face, obverse face or reverse face of the first block, or the end face, the lower side face or the upper side face of the second block, of a third said trim piece.

In yet another aspect of the invention, there is provided a method of installing trim pieces to form decorative trim on one or more building walls, the method comprising the steps of:

(A) installing a said piece in a horizontal position on a first wall with the first block located at an inside corner formed by the juncture of said first wall and a second wall, and as required, any of the following steps (B) to (F):

(B) (i) removing the first block from an uninstalled piece so as to provide the elongate member thereof with a free end for abutment against the end face of the second block of another piece; and (ii) installing the uninstalled piece on either the first wall or the second wall in aligned orientation with a previously installed piece and with the free end thereof in abutment with the end face of the second block of the previously installed piece;

(C) repeating steps (B)(i) and B(ii);

(D) removing the second block from an uninstalled piece so as to provide the elongate member thereof with a free end for abutment against the face of another trim piece, and installing the uninstalled piece in a horizontal position on the second wall and with the first free end thereof in abutment with the obverse face of the first block of the piece installed in step (A);

(E) (i) removing the second block from an uninstalled piece so as to provide the elongate member thereof with a free end for abutment against the end face of the first block of another piece; and (ii) installing the uninstalled piece on either the first wall or the second wall in aligned orientation with a previously installed piece and with the free end thereof in abutment with the end face of the first block of the previously installed piece;

(F) repeating steps (i)(i) and (E)(ii),

In still another aspect of the invention, there is provided a method of installing trim pieces to form decorative trim on one or more building walls, the method comprising the steps of:

(A) installing a said piece in a horizontal position on a first wall with the first block located at an outside corner formed by the juncture of said first wall and a second wall, and as required, any of the following steps (B) to (F)

(B) (i) removing the first block from an uninstalled piece so as to provide the elongate member thereof with a free end for abutment against the end face of the second block of another piece; and (ii) installing the uninstalled piece on either the first wall or the second wall in aligned orientation with a previously installed piece and with the free end thereof in abutment with the end face of the second block of the previously installed piece;

(C) repeating steps (B)(i) and B(ii), (D) removing the second block from an uninstalled piece so as to provide the elongate member thereof with a free end for abutment against the face of another trim piece, and installing the uninstalled piece in a horizontal position on the second wall and with the first free end thereof in abutment with the reverse face of the first block of the piece installed in stop (A);

(E) (i) removing the second block from an uninstalled piece so as to provide the elongate member thereof with a free end for abutment against the end face of the first block of another piece; and (ii) installing the uninstalled piece on either the first wall or the second wall in aligned orientation with a previously installed piece and with the free end thereof in abutment with the end face of the first block of the previously installed piece;

(F) repeating steps (EXi) and (E)(ii).

In yet another aspect of the invention, there is provided a method of installing trim pieces to form decorative trim on a common building wall, the method comprising the steps of:

(A) installing a said piece in a horizontal position on the common wall, and as required, any of the following steps (B) to (F):

(B) (i) removing the first block from an uninstalled piece so as to provide the elongate member thereof with a free end for abutment against the end face of the second block of another piece; and (ii) installing the uninstalled piece on the common wall in aligned orientation with a previously installed piece and with the free end thereof in abutment with the end face of the second block of the previously installed piece;

(C) repeating steps (13)(i) and B(ii), (D) removing the second block from an uninstalled piece so as to provide the elongate member thereof with a free end for abutment against the face of another trim piece, and installing the uninstalled piece in a vertical position on the common wall and with the first free end thereof in abutment with the lower face or upper face of the first block of the piece installed in step (A);

(E) (i) removing the second block from an uninstalled piece so as to provide the elongate member thereof with a free end for abutment against the end face of the first block of another piece; and (ii) installing the uninstalled piece on the common wall in aligned orientation with a previously installed piece and with the free end thereof in abutment with the end face of the first block of the previously installed piece;

(F) repeating steps (E)(i) and (E)(ii).

In still another aspect of the invention, there is provided a method of installing trim pieces to form decorative trim on the common wall, the method comprising the steps of installing a first said trim piece on the common wall; obtaining a second said trim piece with a free end at the end of the elongate member opposite the block; and installing the second said trim piece on the common wall in position with the first said trim piece to form a corner on the common wall and with the free end of the second trim piece in abutment with the face of the block of the first said trim piece.

In still another aspect of the invention, there is provided a method of installing trim pieces to form decorative trim on an inside corner formed by the juncture of a first and a second wall, the method comprising the steps of installing a first said trim piece on the first wall so the block is located at the inside corner; obtaining a second said trim piece with a free end at the end of the elongate member opposite the block, and installing the second said trim piece on the second wall in position to complete the inside corner with the first said trim piece and with the free end of the second trim piece in abutment with the obverse face of the block of the first said trim piece.

In still another aspect of the invention, there is provided a method of installing trim pieces to form decorative trim on an outer corner formed by the juncture of a first and a second wall, the method comprising the steps of: installing a first said trim piece on the first wall so the block is located at the outside corner; obtaining a second said trim piece with a free end at the end of the elongate member opposite the block, and installing the second said trim piece on the second wall in position to complete the outside corner with the first said trim piece and with the free end of the second trim piece in abutment with the reverse face of the block of the first said trim piece.

In still another aspect of the invention, there is provided a method of manufacturing a unitary decorative trim wherein the elongate member and block are formed as a single piece. In another feature of this aspect, the unitary decorative trim is made by an open cast molding process. In still another feature of this aspect, the unitary decorative trim is made by an injection molding process. In yet another feature of this aspect, the unitary decorative trim is from polyurethane.

DETAILED DESCRIPTION OF EXEMPLARY EMBODIMENTS

Figure 1:
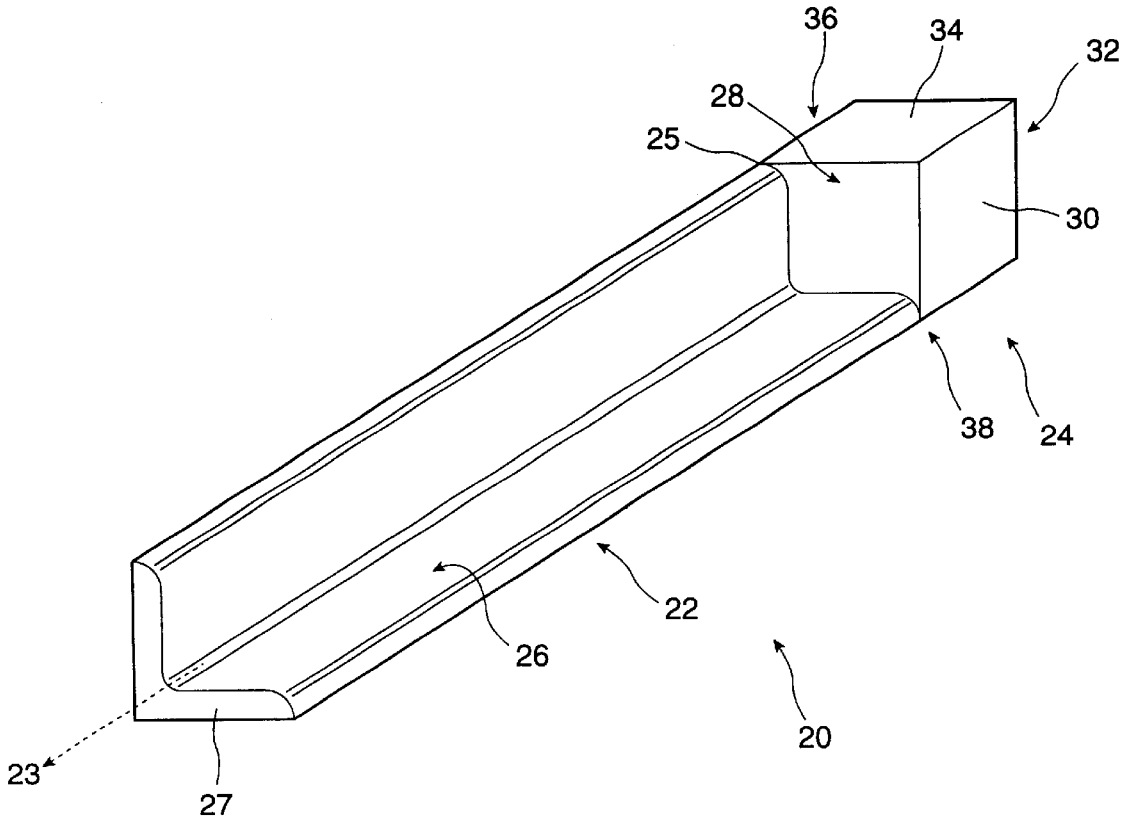
FIG. 1 is a perspective view of a first embodiment of a decorative trim piece.

An embodiment of the invention is shown in FIG. 1. Turning to FIG. 1, decorative trim piece 20 includes an elongate member 22 with a central axis 23 attached to a block 24. Elongate member 22 has a obverse face 26. Block 24 has a face 28 to which elongate member 22 is attached at end 25. Elongate member 22 has an end 21 which is not covered. In the embodiment of FIG. 1, block 24 is a cube, and so has five faces in addition to face 28: end face 32 which is orthogonal to axis 23, an obverse face 34 orthogonal to end face 32, a reverse face 38 orthogonal to end face 32, a lower side face 30 orthogonal to end face 32, and an upper side face 36 orthogonal to end face 32.

Figure 2:
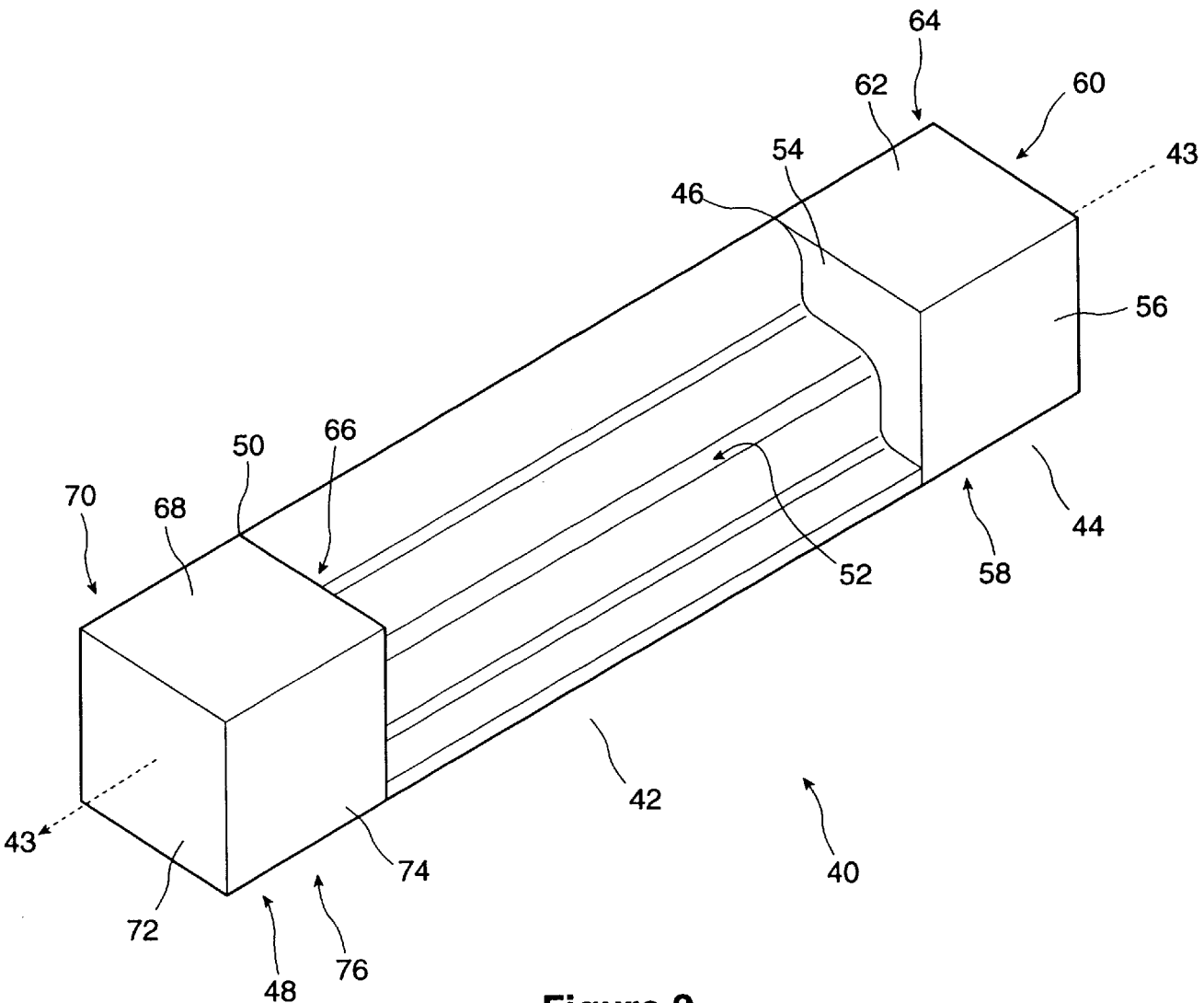
FIG. 2 is a perspective view of a second embodiment of a decorative trim piece.

A second embodiment of the invention is shown in FIG. 2. Turning to FIG. 2, decorative trim piece 40 includes an elongate member 42 having a central axis 43 attached to a block 44 at end 46 and attached to a second block 48 at end 50. Elongate member 42 has an obverse face 52. Block 44 has a face 54 to which elongate member 42 is attached at end 46. In the embodiment of FIG. 2, block 44 is a cube, and so has five faces in addition to face 54: end face 60 which is orthogonal to axis 43, an obverse face 62 orthogonal to end face 60, a reverse face 58 orthogonal to end face 60, a lower side face 56 orthogonal to end face 60, and an upper side face 64 orthogonal to end face 60. Similarly, block 48 has a face 66 to which elongate member 42 is attached at end 50. Block 48 is a cube, and so has five faces in addition to face 66: end face 72 which is orthogonal to axis 43, an obverse face 68 orthogonal to end face 72, a reverse face 76 orthogonal to end face 72, a lower side face 14 orthogonal to end face 72, and an upper side face 70 orthogonal to end face 72.

The trim piece embodiment 20 in FIG. 1 and the trim piece embodiment 40 in FIG. 2 are related in that, if a square cut is made in the elongate member 42 of FIG. 2, a trim piece embodiment 20 and an inverse of trim piece 20 are created.

The trim pieces of the invention are provided as single pieces to the consumer and are thus called "unitary". A preferred manufacturing process is to prepare the piece in a mold (such as an open-cast mold). In such a process it is thus convenient to manufacture all portions of the piece in a single step. This does not imply that during the manufacturing stage, a block and an elongate member of a trim piece could not be manufactured as separate parts and affixed to each other for sale to a consumer.

Figure 3:
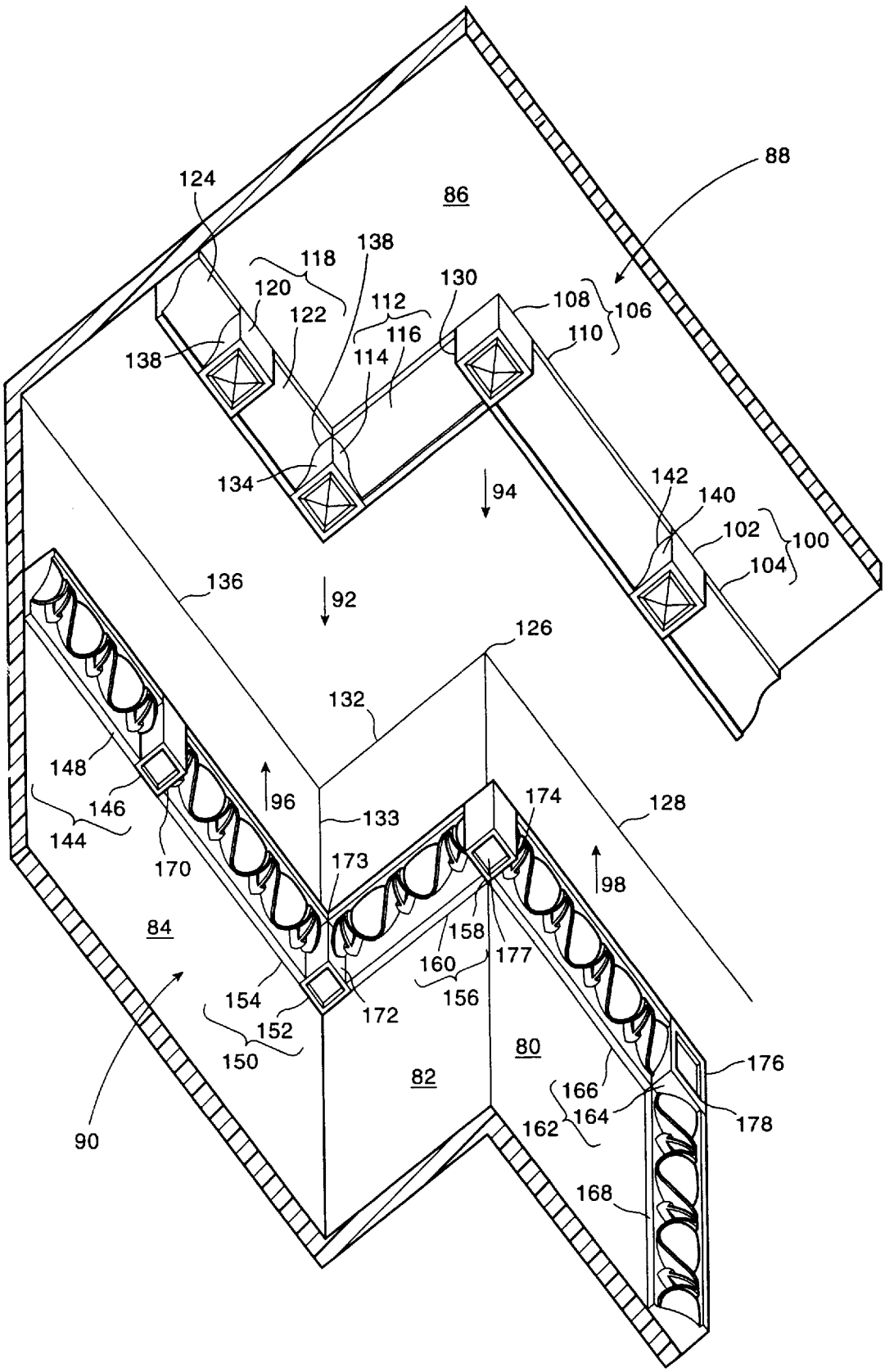
FIG. 3 is a perspective view of several decorative trim pieces, illustrating their installation around several walls and a ceiling.

The installation of the decorative trim pieces is illustrated in FIG. 3. Tuning to FIG. 3, walls 80, 82 and 84 are attached to a ceiling 86. Two alternative installations of several decorative trim pieces 88 and 90 are shown.

Several trim pieces 88 includes: decorative trim piece 100 which has block 102 attached to elongate member 104; decorative trim piece 106 which has block 108 attached to elongate member 110; decorative trim piece 112 which has block 114 attached to elongate member 116; decorative trim piece 118 which has block 120 attached to elongate member 122; and elongate member 124 which extends off the edge of the figure.

In installation, decorative trim piece 106 is attached to the ceiling 86. Trim piece 112 is in turn placed so elongate member 116 abuts reverse face 130 of block 108. This creates a turn in the trim around a imaginary ninety degree outer corner. Similarly, trim piece 118 is in turn a placed so elongate member 122 abuts obverse face 134 of block 114. This creates a turn in the trim around a imaginary ninety degree inner corner. In turn, elongate member 124 may be abutted against end face 138 of block 120. This extends the trim along the axis of trim piece 118. Similarly, end face 140 of block 102 of trim piece 100 may be abutted against end 142 of elongate member 110 to extend the trim in the axis of trim piece 106.

In FIG. 3, the several trim pieces 88 have elongate members that simply present a curved obverse face. The blocks have a square point on their lower faces.

It should be noted that, if the elongate members of trim pieces 88 are cut to the appropriate lengths (by making square cuts in the elongate members) and moved in the direction of arrows 92 and 94, the several trim pieces 8: could fit snugly against walls 80, 82 and 84.

Several trim pieces 90 includes; trim piece 144 which has block 146 attached to elongate member 148; trim piece 150 which has block 152 attached to elongate member 154; trim piece 156 which has block 158 attached to elongate member 160; trim piece 162 which has block 164 attached to elongate member 166; and elongate member 168 which extends off the edge of the figure, In installation, trim piece 150 is attached to wall 84 in position so that block 152 rests in corner 133. Trim piece 144 is in turn placed so end face 170 of block 146 abuts elongate member 154. This extends the trim in the same axis as trim piece 150.

Trim piece 156 is cut (by making a square cut in elongate member 160) and placed X attached to wall 32 so that end 173 of elongate member 160 abuts obverse face 172 of block 152, and reverse face 174 of block 158 faces down wall 80. This creates a turn in the trim around ninety degree inner corner 133. Similarly, trim piece 162 is cut (by making a square cut in elongate member 166) and placed attached to wall 80 so that end 177 of elongate member 166 abuts reverse face 174 of block 158, and block 164 rests against wall 80 so that lower face 178 of block 164 faces down wall 80. Further trim pieces (represented by elongate member 168) may be placed in a direction orthogonal to lower face 178. This creates a ninety-degree corner in the trim on common wall 80.

It should be noted that, if the elongate members of trim pieces 90 are cut to the appropriate lengths (by making square cuts in the elongate members) and moved in the direction of arrows 96 and 98, the several trim pieces 90 could fit snugly against ceiling 86.

It should be noted that block 164 is a different shape than blocks 146, 152 and 153. The face against which an end of an elongate piece is to abut, lower face 178, should be of a size suitable to have the end of a decorative trim piece abut against it, or to be of similar size to the other faces which abut the end of an elongate piece. Since the installation takes a 90 degree turn to a different plane than the previous decorative trim pieces in the several decorative trim pieces 90, a differently shaped block is needed.

The cuts needed to install decorative trim pieces as illustrated in FIG. 3 are square cuts, not mitre cuts, Square cuts are much easier to make properly than mitre cuts, and particularly so for the "do it-yourself" home improvement market.

As seen in FIG. 3, in the multiple trim pieces 90, two types of blocks are used: the thinner blocks 146, 152 and 158, and thicker block 164. These different blocks are used, respectively, to run the trim either in a straight line along a wall or around an inner or outer corner, and to run the trim around a corner on a wall.

Figure 4A:
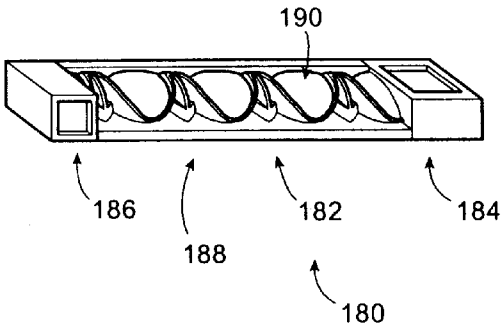
FIG. 4A is a perspective view of a third embodiment of a decorative trim piece, with two different blocks allowing of additional decorative trim pieces in different directions.
Figure 4D:
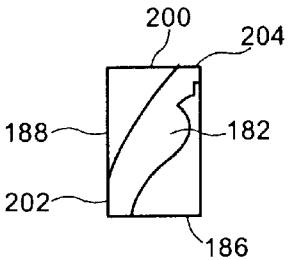
FIG. 4D is a cut away view of an alternative embodiment of the decorative trim piece of FIG. 4A.
Figure 4B:
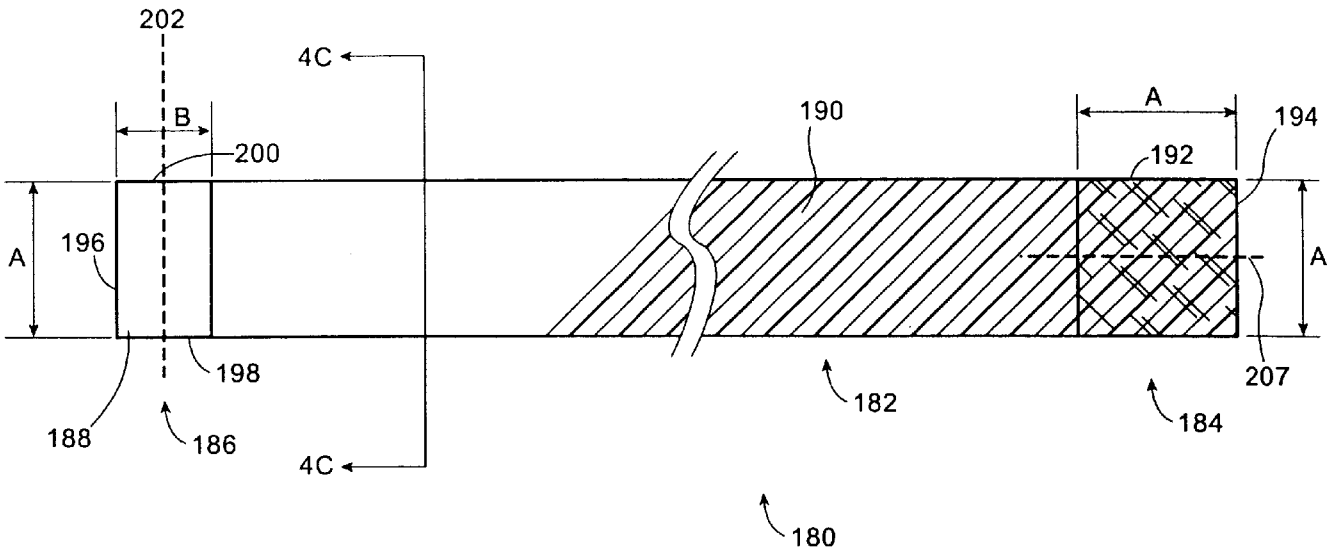
FIG. 4B is a elevation view of the decorative trim piece of FIG. 4A.
Figure 4C:
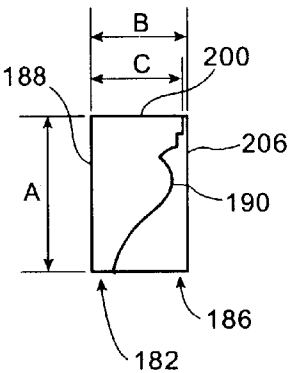
FIG. 4C is a cut-away view or section of decorative trim piece of FIG. 4A along cut 4C in FIG. 4B.

A particularly preferred embodiment is a trim piece with two different blocks to allow the trim pieces to be aligned with each other, installed around inside corners, around outside corners, or to form 90 degree turns (in either an inner or outer direction), or both as desired. This is further explained in FIGS. 4A and 4B. Turning to FIG. 4A, trim piece 180 has an elongate member 182 with two differently-shaped blocks 134 and 186. This trim piece 180 may be seen in elevation view from the obverse face 190 in FIG. 4B. Tuning to FIG. 4B, block 134 has a length A on sides 192 and 194. In contrast, block 186 has a length A on side 196 but a length B on sides 198 and 200. FIG. 4C is a side view along cut 4C in FIG. 4B. Turning to FIG. 4C, block 186 has a length A on side 188 and a length B on side 200. Decorative obverse side 190 may be somewhat shorter (but is usually not longer) than the length of side 200, a seen in FIG. 4C, where decorative obverse side has a length of C.

Since block 186 has a length of A in only sides 188 and 196 and not in side 198, block 196 only allows ninety degree changes in direction in the plane of elongate member 182 rotated around an axis 202. In contrast, block 184 has sides 192, 194 and 208 with a length A, and so allows ninety degree changes of direction from axis 207 as well as allowing the trim to continue in the direction of axis 207.

As seen in FIG. 4C, the elongate member 182 extends to lie along side 188 and side 200. When installed, trim piece 180 is attached to an abutting surface, typically along side 188, although attachment along either or both of sides 188 and 200 is possible. However, as seen in FIG. 4D, elongate member 182 only needs to run partially along sides 188 and 200 (portions 202 and 204, respectively) to allow for attachment to abutting surfaces.

Figure 5:
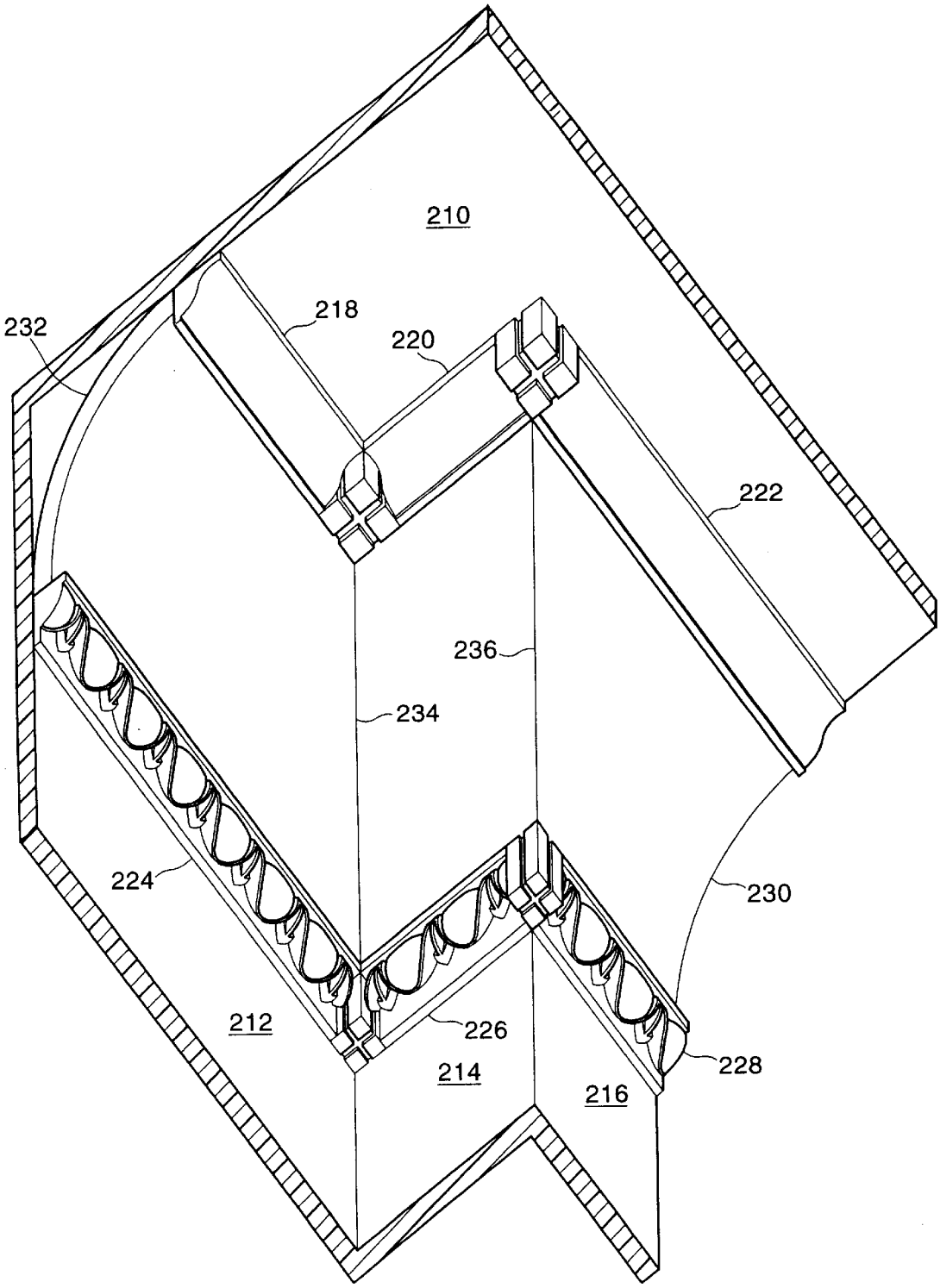
FIG. 5 is a perspective view of an installation of decorative trim pieces with a coving.

In a preferred embodiment, the trim pieces are sold with a block arrangement as seen in trim piece 180 of FIG. 4A, with instructions to cut off either of the blocks 184 and 186 (and ends of elongate member 182) as necessary. Alternatively, trim piece 180 could be constructed so the blocks 184 and 186 are attached to elongate member 182 by a frangible web and are easily detached, although as a practical matter this would require injection molding rather than open cast molding to produce. The trim pieces may be made from polyurethane. The relative dimensions of the decorative trim pieces, such as A and B in FIGS. 4B and 4C, and the length of the elongate members, may be varied to suit the application or particular installation. The style of the decoration or ornamentation and the sizes of the decorative trim pieces may be varied to suit particular installations and applications. In some cases, the overall length of the trim piece would vary from 6 feet to 12 feet with A being around 1¼ inch and B around 1 inch. It would be possible to have the elongate member range from 12 inches to 3 feet to 20 feet or even longer depending upon the application. The lengths A can also vary, being 6 inches, 12 inches or even 36 inches, and length B also varying, with lengths such as 5 inches, 10 inches or 30 inches, FIG. 5 shows the trim pieces used in conjunction with a coving. Turning to FIG. 5, there is a ceiling 210, and walls 212, 214 and 216, Trim pieces 218, 220 and 222 are attached to the ceiling 210, while trim pieces 224, 226 and 228 are attached to walls 212, 214 and 216. Covings 230 and 232 are attached to the ceiling and walls to abut the trim pieces, and are mitred at corners 234 and 236.

Some faces of the blocks in FIGS. 1, 2, 3 and 4A-4D have been described as "orthogonal" to the central axis of the various trim pieces. It is to be understood that "orthogonal" means orthogonal within the tolerances commonly encountered in the building profession. In particular, the description of the fares as "orthogonal" should be taken to encompass variations from strict orthogonality that would still permit the trim pieces to be effectively used as described in this application.

Figure 6:
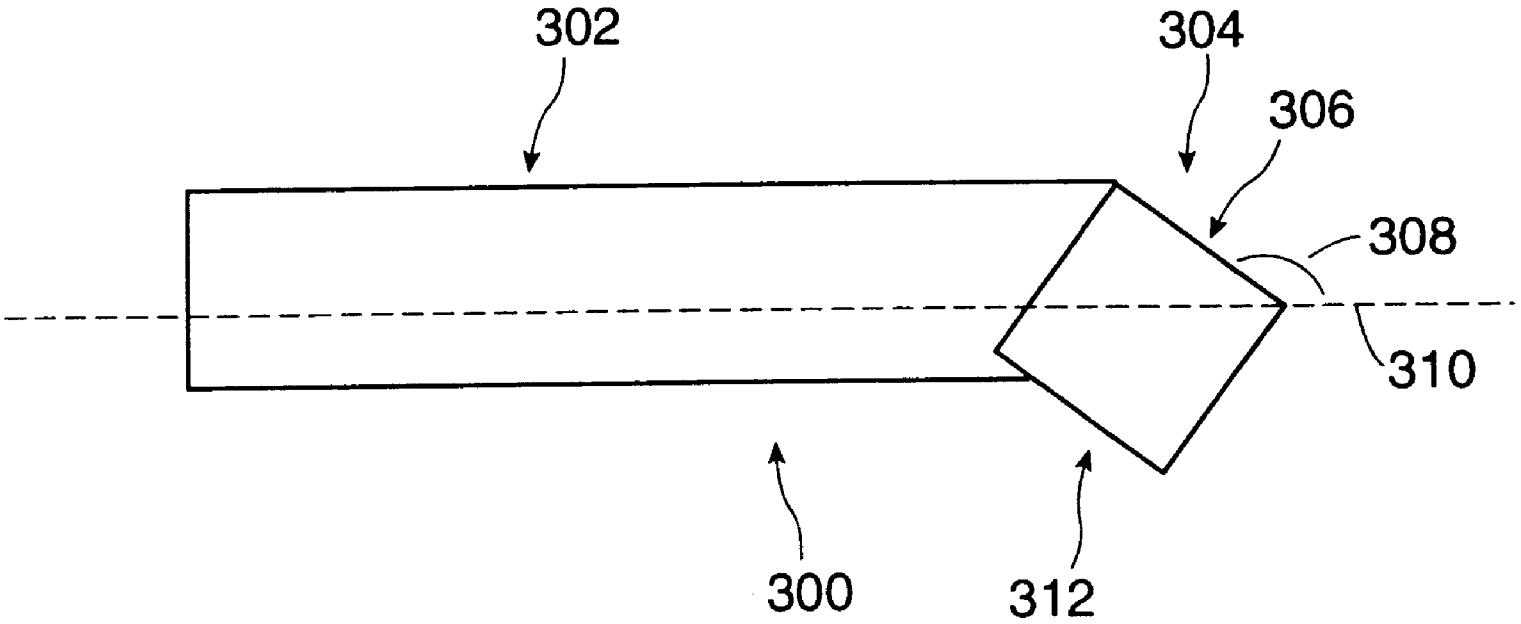
FIG. 6 is a plan view of a decorative trim piece for use with a corner with an obtuse angle.

It should also be recognized by those skilled in the art that similar decorative trims can be produced to fit around inside or outside corners with angles at other than right angles. FIG. 6 shows a decorative trim piece 300 with an elongate member 302 and block 304. Face 306 is at an obtuse angle 308 to central axis 310 of elongate member 302, allowing trim piece 300 to be used with corresponding obtuse corners. Similarly, face 312 is at an acute angle to central axis 310, allowing trim piece 300 to be used with corresponding acute corners.

Those skilled in the art will appreciate that various modifications of detail may be made to the preferred embodiments described herein, which would come within the spirit and scope of the invention as described in the following claims.

What is claimed is:

1. A unitary decorative trim piece for installation on a building surface, the trim piece comprising:

an elongate member having a central axis;

a block at a first end of the member wherein:

the block has an end face substantially orthogonal to the axis for receipt thereagainst of the end of another trim piece when the pieces are aligned with each other for installation on a common surface.

2. The trim piece of claim 1 wherein the block has an obverse face substantially orthogonal to the end face for receipt thereagainst of the end of another trim piece when the pieces are positioned for installation at an inside corner formed at the juncture of adjacent walls.

3. The trim piece of claim 1 wherein the block has a reverse face substantially orthogonal to the end face for receipt thereagainst of the end of another trim piece when the pieces are positioned for installation at an outside corner formed at the juncture of adjacent walls.

4. The trim piece of claim 1 wherein the block has a lower side face substantially orthogonal to the end face for receipt thereagainst of the end of another trim piece when the pieces are positioned to together form a corner on a common surface.

5. The trim piece of claim 1 wherein the block has an upper side face substantially orthogonal to the end face for receipt thereagainst of the end of another trim piece when the pieces are positioned to together form a corner on a common surface.

6. The trim piece of claim 2 wherein the block has a reverse face substantially orthogonal to the end face for receipt thereagainst of the end of another trim piece when the pieces are positioned for installation at an outside corner formed at the juncture of adjacent walls.

7. The trim piece of claim 4 wherein the block has an upper side face substantially orthogonal to the end face for receipt thereagainst of the end of another trim piece when the pieces are positioned to together form a corner on a common surface.

8. A unitary decorative trim piece for installation on a building surface, the trim piece comprising:

an elongate member having a decorative obverse face, and a central axis, first and second blocks at first and second ends of the member; wherein:

each of the blocks has an end face substantially orthogonal to the axis for receipt thereagainst of the end of another trim piece when the pieces are aligned with each other for installation on a common wall;

the first block has an obverse face substantially orthogonal to the end face for receipt thereagainst of the end of another trim piece when the pieces are positioned for installation at an inside corner formed at the juncture of adjacent walls and has a reverse face substantially orthogonal to the end face for receipt thereagainst of the end of another trim piece when the pieces are positioned for installation at an outside corner formed at the juncture of adjacent walls; and the second block has a lower side face substantially orthogonal to the end face for receipt thereagainst of the end of another trim piece when the pieces are positioned to together form a corner on a common surface and has an upper side face substantially orthogonal to the end face for receipt thereagainst of the end of another trim piece when the pieces are positioned to together form a corner on a common surface.

9. The trim piece of claim 8 wherein the obverse face of the first block is parallel to the reverse face of the first block, and the lower side face of the second block is parallel to the upper side face of the second block.

10. A unitary decorative trim piece for installation on a building surface, the trim piece comprising:

an elongate member having a decorative obverse face; and a block at an end of the elongate member, wherein the block has a face for receipt thereagainst of the end of another trim piece when the pieces are aligned with each other for installation to form a corner on a common wall.

11. A unitary decorative trim piece for installation on a building surface, the trim piece comprising:

an elongate member having a decorative obverse face; and a block at an end of the elongate member, wherein the block has a face for receipt thereagainst of the end of another trim piece when the pieces are positioned with each other for installation at an inside corner.

12. A unitary decorative trim piece for installation on a building surface, the trim piece comprising:

an elongate member having a decorative obverse face; and a block at an end of the elongate member, wherein the block has a face for receipt thereagainst of the end of another trim piece when the pieces are positioned with each other for installation on an outer corner.

13. A unitary decorative trim piece for installation on a building surface, the trim piece comprising:

an elongate member having a central axis;

a first block at a first end of the member; wherein the first block has an end face substantially orthogonal to the axis for receipt thereagainst of the end of another trim piece when the pieces are aligned with each other for installation on a common surface;

the first block has an obverse face substantially orthogonal to the end face for receipt thereagainst of the end of another trim piece when the pieces are positioned for installation at an inside corner formed at the juncture of adjacent walls; and the first block has a reverse face substantially orthogonal to the end face for receipt thereagainst of the end of another trim piece when the pieces are positioned for installation at an outside corner formed at the juncture of adjacent walls.

14. The unitary decorative trim piece of claim 13, further comprising a second block at a second end of the member; wherein:

the second block has an end face substantially orthogonal to the axis for receipt thereagainst of the end of another trim piece when the pieces are aligned with each other for installation on a common surface;

the second block has an upper face substantially orthogonal to the end face for receipt thereagainst of the end of another trim piece when the pieces are positioned to together form a corner on a common surface; and the second block has a lower face substantially orthogonal to the end face for receipt thereagainst of the end of another trim piece when the pieces are positioned to together form a corner on a common surface.

15. The trim piece of claim 8 wherein the end face of the first block is parallel to the end face of the second block, the obverse face of the first block is parallel to the reverse face of the first block, and the lower side face of the second block is parallel to the upper side face of the second block.

16. A commercial package comprising (a) a trim piece of claim 8 and (b) instructions for removing at least one of the blocks thereof so as to provide the elongate member with a free end for abutment with the end face, obverse face or reverse face of the first block, or the end face, the lower side face or the upper side face of the second block, of a second said trim piece.

17. A commercial package comprising (a) a trim piece of claim 8 and (b) instructions for removing at least one of the blocks thereof and removing part of the elongate member with a square cut so as to provide the elongate member with a free end for abutment with the end face, obverse face or reverse face of the first block, or the end face, the lower side face or the upper side face of the second block, of a second said trim piece.

18. A commercial package comprising (a) a trim piece of claim 8 and (b) instructions for removing at both of the blocks thereof so as to provide the elongate member with a first free end for abutment with the end face, obverse face or reverse face of the first block, or the end face, the lower side face or the upper side face of the second block, of a second said trim piece and a second free end for abutment with the end face, obverse face or reverse face of the first block, or the end face, the lower side face or the upper side face of the second block, of a third said trim piece.

19. A method of installing trim pieces of claim 8 to form decorative trim on one or more building walls, the method comprising the steps of:

(A) installing a piece in a horizontal position on a first wall with the first block located at an inside corner formed by the juncture of said first wall and a second wall, and as required, any of the following steps (B) to (F):

(B) (i) removing the first block from an uninstalled piece so as to provide the elongate member thereof with a free end for abutment against the end face of the second block of another piece; and (ii) installing the uninstalled piece on either the first wall or the second wall in aligned orientation with a previously installed piece and with the free end thereof in abutment with the end face of the second block of the previously installed piece;

(C) repeating steps (1)(i) and B(ii);

(D) removing the second block from an uninstalled piece so as to provide the elongate member thereof with a free end for abutment against the face of another trim piece, and installing the uninstalled piece in a horizontal position on the second wall and with the first free end thereof in abutment with the obverse face of the first block of the piece installed in step (A);

(E) (i) removing the second block from an uninstalled piece so as to provide the elongate member thereof with a free end for abutment against the end face of the first block of another piece; and (ii) installing the uninstalled piece on either the first wall or the second wall in aligned orientation with a previously installed piece and with the free end thereof in abutment with the end face of the first block of the previously installed piece;

(F) repeating steps (E)(i) and (E)(ii).

20. A method of installing trim pieces of claim 8 to form decorative trim on one or more building walls, the method comprising the steps of:

(A) installing a piece in a horizontal position on a first wall with the first block located at an outside corner formed by the juncture of said first wall and a second wall, and as required, any of the following steps (B) to (F):

(B) (i) removing the first block from an uninstalled piece so as to provide the elongate member thereof with a free end for abutment against the end face of the second block of another piece; and (ii) installing the uninstalled piece on either the first wall or the second wall in aligned orientation with a previously installed piece and with the free end thereof in abutment with the end face of the second block of the previously installed piece;

(C) repeating steps (B)(i) and B(ii);

(D) removing the second block from an uninstalled piece so as to provide the elongate member thereof with a free end for abutment against the face of another trim piece, and installing the uninstalled piece in a horizontal position on the second wall and with the first free end thereof in abutment with the reverse face of the first block of the piece installed in step (A);

(E) (i) removing the second block from an uninstalled piece so as to provide the elongate member thereof with a free end for abutment against the end face of the first block of another piece; and (ii) installing the uninstalled piece on either the first wall or the second wall in aligned orientation with a previously installed piece and with the free end thereof in abutment with the end face of the first block of the previously installed piece;

(F) repeating steps (E)(i) and (E)(ii).

21. A method of installing trim pieces of claim 8 to form decorative trim on a common building wall, the method comprising the steps of (A) installing a piece in a horizontal position on the common wall, and as required, any of the following steps (B) to (F):

(B) (i) removing the first block from an uninstalled piece so as to provide the elongate member thereof with a free end for abutment against the end face of the second block of another piece; and (ii) installing the uninstalled piece on the common wall in aligned orientation with a previously installed piece and with the free end thereof in abutment with the end face of the second block of the previously installed piece;

(C) repeating steps (B)(i) and B(ii);

(D) removing the second block from an uninstalled piece so as to provide the elongate member thereof with a free end for abutment against the face of another trim piece, and installing the uninstalled piece in a vertical position on the common wall and with the first free end thereof in abutment with the lower face or upper face of the first block of the piece installed in step (A);

(E) (i) removing the second block from an uninstalled piece so as to provide the elongate member thereof with a free end for abutment against the end face of the first block of another piece; and (ii) installing the uninstalled piece on the common wall in aligned orientation with a previously installed piece and with the free end thereof in abutment with the end face of the first block of the previously installed piece;

(F) repeating steps (E)(i) and (E)(ii).

22. A method of installing trim pieces of claim 10 to form decorative trim on the common wall, the method comprising the steps of:

installing a first trim piece on the common wall;

obtaining a second trim piece with a free end at the end of the elongate member opposite the block; and installing the second trim piece on the common wall in position with the first trim piece to form a corner on the common wall and with the free end of the second trim piece in abutment with the face of the block of the first trim piece.

23. A method of installing trim pieces of claim 11 to form decorative trim on an inside corner formed by the juncture of a first and a second wall, the method comprising the steps of:

installing a first trim piece on the first wall so the block is located at the inside corner; obtaining a second trim piece with a free end at the end of the elongate member opposite the block; and installing the second trim piece on the second wall in position to complete the inside corner with the first trim piece and with the free end of the second trim piece in abutment with the obverse face of the block of the first trim piece.

24. A method of installing trim pieces of claim 12 to form decorative trim on an outer corner formed by the juncture of a first and a second wall, the method comprising the steps of:

installing a first trim piece on the first wall so the block is located at the outside corner; obtaining a second trim piece with a free end at the end of the elongate member opposite the block; and installing the second trim piece on the second wall in position to complete the outside corner with the first trim piece and with the free end of the second trim piece in abutment with the reverse face of the block of the first trim piece.

25. The method of manufacturing a unitary decorative trim of any one of claims 11 and 12 wherein the elongate member and block are formed as a single piece.

26. The method of manufacture of claim 25 wherein the unitary decorative trim is made by an open cast molding process.

27. The method of manufacture of claim 25 wherein the unitary decorative trim is made by an injection molding process.

28. The method of manufacture of claim 25 wherein the unitary decorative trim is made from urethane.

29. The unitary decorative trim of any one of claims 11 and 12 wherein the ratio of the length of the elongate member in the direction of the longitudinal axis of the elongate member to the length of the block in the direction of the longitudinal axis of the elongate member is at least 12:1.

30. The unitary decorative trim of any one of claims 11 and 12 wherein the ratio of the length of the elongate member in the direction of the longitudinal axis of the elongate member to the length of the block in the direction of the longitudinal axis of the elongate member is at least 20:1.

* * * * *

UNITED STATES PATENT AND TRADEMARK OFFICE

CERTIFICATE OF CORRECTION

PATENT NO. : 6,516,576 B1
DATED : February 11, 2003
INVENTOR(S) : Brad Balmer

It is certified that error appears in the above-identified patent and that said Letters Patent is hereby corrected as shown below:

Title page,
Item [73], correct the name of the Assignee to read -- 1042444 Ontario Inc. --

Signed and Sealed this

Third Day of June, 2003

JAMES E. ROGAN
*Director of the United States Patent and Trademark Office*